United States Patent [19]

Horiuchi et al.

[11] Patent Number: 5,036,821

[45] Date of Patent: Aug. 6, 1991

[54] FUEL INJECTION SYSTEM FOR AN INTERNAL COMBUSTION ENGINE

[75] Inventors: Yasuhiro Horiuchi, Toyota; Tetsuya Toyao, Kariya; Takeshi Takahashi, Mishima, all of Japan

[73] Assignee: Toyota Jidosha Kabushiki Kaisha, Toyota, Japan

[21] Appl. No.: 432,676

[22] Filed: Nov. 7, 1989

[30] Foreign Application Priority Data

Nov. 7, 1988 [JP] Japan ..... 63-281025

[51] Int. Cl.[5] ..... F02M 37/04

[52] U.S. Cl. ..... 123/506; 123/446; 123/498

[58] Field of Search ..... 123/458, 498, 446, 447, 123/506, 503

[56] References Cited

U.S. PATENT DOCUMENTS

| | | | |
|---|---|---|---|
| 4,082,481 | 4/1978 | Fenne . | |
| 4,550,744 | 11/1985 | Igashira | 123/447 |
| 4,643,155 | 2/1987 | O'Neill | 123/383 |
| 4,660,523 | 4/1987 | Brauer | 123/498 |
| 4,697,565 | 10/1987 | Kobayashi et al. | 123/458 |
| 4,730,585 | 3/1988 | Abe | 123/506 |
| 4,782,807 | 11/1988 | Takahashi | 123/506 |
| 4,793,314 | 12/1988 | Yoshinaga | 123/506 |
| 4,838,233 | 6/1989 | Hayashi | 123/506 |
| 4,917,068 | 4/1990 | Takahashi | 123/506 |

FOREIGN PATENT DOCUMENTS

| | | |
|---|---|---|
| 61-12109 | 4/1986 | Japan . |
| 1557179 | 12/1979 | United Kingdom . |

*Primary Examiner*—Carl Stuart Miller

*Attorney, Agent, or Firm*—Cushman, Darby & Cushman

[57] ABSTRACT

A fuel injection system for an internal combustion engine, wherein a spill valve device operated by a piezoelectric unit is provided for carrying out a pressure pump spill operation when a fuel injection stroke is completed. The spill valve device includes a operating chamber connected to a sealed chamber of the piezoelectric unit, the sealed chamber being connected to a fuel supplementing passageway which is connected to a fuel passageway connecting a fuel tank with a fuel intake port of the pressure pump. The pressure pump is further provided with a spill passageway for discharging pressurized fuel in the pressure chamber via the fuel passageway. A check valve is provided in the fuel passageway to prevent a flow of the spilled fuel to the sealed chamber of the piezoelectric unit.

4 Claims, 6 Drawing Sheets

FUEL INJECTION SYSTEM FOR AN INTERNAL COMBUSTION ENGINE

BACKGROUND OF THE INVENTION

1. Field of the Invention

The present invention relates to a fuel injection apparatus for supplying fuel from a fuel tank to an internal combustion engine for a vehicle, and more particularly, to a fuel injection apparatus wherein the fuel injection is stopped by a discharging the pressure in a fuel injection nozzle via a spill control valve device.

2. Description of the Related Arts

In a known fuel injection device for an internal combustion engine for a vehicle, the pressure is discharged at a point upstream of a fuel injection nozzle by a spill valve device, to stop a fuel injection operation. A spill valve device provided with a spill valve body and piezoelectric actuator has been proposed in, for example, U.S. Pat. No. 4,643,155 and Japanese Patent Publication No. 61-12109.

In the above-mentioned type of piezoelectric actuator, a drive power therefrom is transmitted to a spill valve body by an amount of fuel used as an operating fluid, whereby a small displacement of the piezoelectric actuator is amplified and transmitted to the spill valve body. Although the operating fluid medium is stored in a sealed oil chamber, unless recharged, the amount of stored operating fluid is gradually depleted over a certain period of operation, and thus the efficiency of the device is lowered. Accordingly, the operating fluid is supplemented via an oil supply passageway. This fuel supplementing passageway connects the sealed chamber to a fuel passageway in which the pressure is higher than a predetermined pressure, i.e., a passageway in which the fuel is charged. The above-mentioned Japanese Patent Publication No. 671-12109 discloses that the delivery outlet of a feed pump for pressurizing the fuel in the fuel tank is connected to the sealed oil chamber via the oil supply passageway, i.e., proposes only a connection of the delivery side of the feed pump to the sealed oil chamber. To produce a practically efficient injection fuel apparatus, the construction must be as simple as possible, and therefore, the following considerations must be taken into account when designing such a fuel passageway. Theree states of pressure exist in a conventional fuel injection apparatus; a low pressure state wherein the pressure in the fuel tank is low, an intermediate pressure state wherein the pressure of the fuel tank is pressurized to a pressure higher than a predetermined value, and a high pressure state wherein the pressure is made much higher than intermediate state pressure by, for example, a pressurizing pump such as a plunger pump. The oil sealed chamber for storing the piezoelectric actuator operating fluid is designed to be connected to a passageway in which the intermediate pressure state prevails, which allows fuel (operating fluid) having a predetermined pressure to be supplied to the chamber. A passageway is provided between the pressurizing pump, in which a high pressure state prevails, and a fuel injection nozzle, for discharging the fuel from the spill chamber to stop the fuel injection when the fuel injection cycle is completed. A fuel having an intermediate pressure is introduced into this spill chamber, in which the intermediate pressure state thus prevails, and the supply passageway usually has an intermediate pressure. Accordingly, a drawback will occur in that the fuel supplementing passageway is open to a very high pressure of the pressurized chamber in the high pressure pump via the passageway through which the fuel is passed.

In the construction of the prior art, if the fuel feeding passageway and the fuel supplementing passageway are connected, a high pressure in the pressure pump or a spill operation as a result of a movement of the spill valve body cause the fuel pressure as spilled to flow to the supplementing fuel passageway, which pressurizes the operating fluid. As a result, the pressure of the operating fluid is increased, and a valve member of the spill valve body, which is operated by the operating fluid, is moved toward the valve seat. Therefore, when commencing a spill operation as a result of a separation of the valve member from the valve seat, the resultant spill pressure is applied to the operating fluid, which moves the valve member toward the valve seat. This reduces the speed of movement of the valve member while opening, and thus the responsitivity of the valve member during the spill operation is decreased.

SUMMARY OF THE INVENTION

An object of the present invention is to provide a fuel injection system having a simplified fuel passageway construction, and capable of preventing a lowering of the response speed while maintaining a fuel supplementing operation for supplying fuel into the sealed chamber of the piezoelectric actuator to replace fuel lost after prolonged use of the system.

According to the present invention, a fuel injection system is provided for an internal combustion engine, comprising:

a fuel tank for storing an amount of fuel;

a feed pump connected to the fuel tank for taking fuel from the fuel tank;

a pressure pump connected to the fuel pump for pressurizing fuel from the feed pump, and having a fuel inlet connected to the feed pump and an output;

a feed passageway means for connecting the feed pump to the pressure pump for introducing fuel to be injected;

a fuel injection nozzle connected to the pressure pump for injecting an amount of pressurized fuel into the engine, and having an inlet for receiving fuel from the outlet of the feed pump and an outlet nozzle for injecting the fuel;

a spill valve device for discharging the fuel to stop the fuel injection;

said spill valve device comprising a spill valve body, and a piezoelectric actuator for operating the spill valve body to create a pressure by which the spill valve device is operated when the piezoelectric actuator is operated;

said spill valve body comprising a housing, a valve member slidably arranged in the housing, an operating chamber connected to the actuator, a valve seat chamber connected between the outlet of the pressure pump and the inlet of the fuel injection nozzle and defining a valve seat on a wall of the housing, and a spill chamber connected to the fuel tank, the valve member being moved toward or away from the valve seat in accordance with the pressure in the operating chamber, said spill chamber being connected to the valve seat chamber carrying out a spill operation when the valve member is moved away from the valve seat;

the piezoelectric actuator including a cylinder, a piston movable in the cylinder, a stack of piezoelectric elements for moving the piston, and a sealed chamber in which the fuel as an operating fluid is charged, the sealed chamber being connected to the operating chamber of the spill valve body, and a passageway means for connecting the sealed chamber to the feed pump for supplementing the fuel in the sealed chamber;

said feed passageway being connected to the fuel supplementing passageway, and;

means arranged in the feed passageway for preventing a flow of a high pressure fuel in the pressure pump to the sealed chamber.

In the above construction, the provision of the valve means prevents a flow of the pressurized fuel in the pressure pump or the pressure of the spilled fuel to the oil chamber, and as a result, a rapid movement of the valve member is obtained. It should be noted that the spill valve body is driven by the piezoelectric actuator via the volume of fuel as the operating fluid charged in the sealed chamber. To supplement lost fuel, the fuel supplementing passageway is connected to the outlet port of the feed pump in which an intermediate level pressure prevails. Therefore, to obtain a simplified construction, the spill chamber of the spill valve body is not only open to the fuel tank but also is connected to the passageway between the fuel pressurizing pump and the feed pump, so that the spill chamber can serve as a relay passageway between the feed pump and the pressurizing pump. This simplification allows the feed pump and/or the spill chamber to be connected to each other, so that the pressure in the pressure pump or spill chamber can be imposed on the operating fluid, and thus generate a force opposing the opening of the spill valve member during the spill operation. According to the present invention, the valve means operates to disconnect a flow from the pressure pump or the spill chamber to the operating fluid during the pressurizing stroke of the plunger, so that the required high speed movement of the spill valve member can be obtained.

DESCRIPTION OF THE PREFERRED EMBODIMENTS

Figure 1:
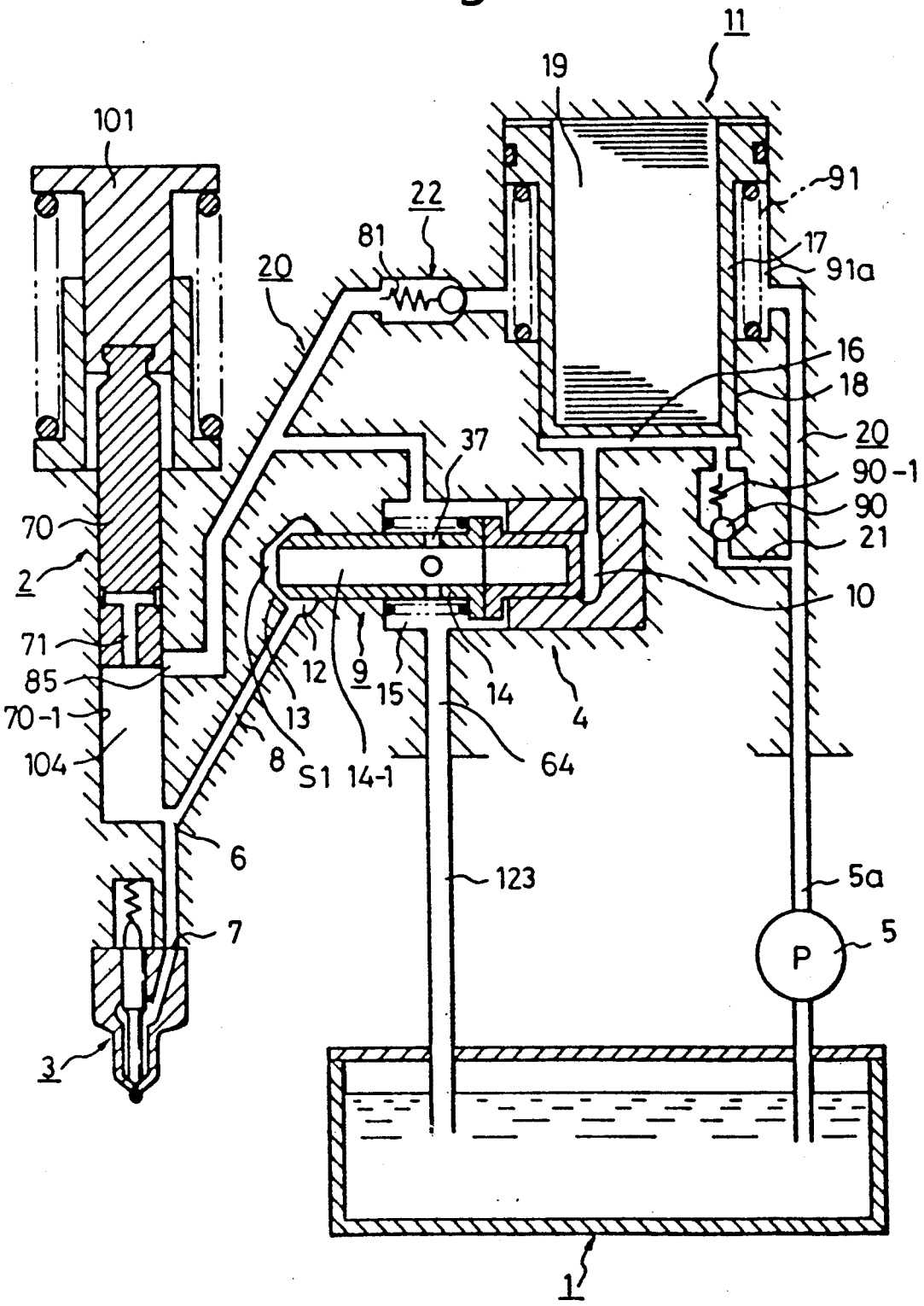
FIG. 1 is a schematic view of the fuel injection system according to the present invention.

In FIG. 1, 1 denotes a fuel tank, and fuel from the tank 1 is pressurized by the plunger pump 2 as a pressurizing pump. The pressurized fuel is sent to a fuel injection nozzle 3, from which the fuel is injected, and when a fuel injection cycle is completed, the flow of fuel to the nozzle 3 is stopped by a spill valve device 4. The fuel is taken from the fuel tank 1 by a feed pump 5, is supplied to the pressurizing pump 2, and is pressurized by the pressure pump 2 before being delivered from an delivery outlet 6 thereof. The fuel from the pressure pump 2 is supplied to the fuel nozzle 3 via a fuel inlet 7 thereof, and when the pressure in the fuel injection nozzle is higher than a predetermined pressure value, the fuel injection nozzle 3 is automatically opened and the fuel is supplied to a cylinder bore (not shown) of an internal combusion engine.

A passageway 8 for allowing the fuel to flow to the spill valve device 4 is connected at one end to a pssageway between the delivery outlet 6 of the pressure pump 2 and the fuel inlet 7 of the fuel nozzle 3. The spill valve device 4 is opened to discharge the fuel upstream of the nozzle 3, to stop the fuel injection operation by the fuel nozzle 3.

The spill valve device 4 is provided with a spill valve body 9 and a piezoelectric actuator 11 for operating the spill valve body 9 via the operating fluid 10. The spill valve body 9 forms a valve seat chamber 12 which is communicated with the fuel injection nozzle 3 by the passageway 8, a valve seat 13 located in the valve seat chamber 12, and a valve member 14 which comes into contact with the valve seat 13 when the pressure of the operating fluid 10 of the piezoelectric actuator 11 is raised and is moved away from the valve seat 13 when the pressure of the operating fluid is lowered. The spill valve device 4 is further provided with a spill chamber 15 for discharging fuel flowing to the fuel injection nozzle 3, when the valve member 14 is separated from the valve seat 13.

The piezoelectric actuator 11 is provided with an oil sealed chamber 16 to which the operating fluid 10 is introduced, a piston 17 for pressurizing the operating fluid 10, and a cylinder portion 18 slidably accommodating the piston 17. The piezoelectric actuator 11 is further provided with a piezoelectric unit 19 for driving the piston 17, and a fuel supplementing passageway connected, via a communication passageway 20, to the spill chamber 15 in the spill valve body 9. The fuel supplementing passageway 21 allows a flow of the fuel from an outlet port **5*a* of the feed pump 5 to the sealed chamber 16**.

A valve member 22 is arranged in the communication passageway 20, and prevents a flow of the spilled pressurized fuel in the passageway 20 to the sealed chamber 16. As a result, a flow of the spilled pressurized fuel from the spill chamber 15 to the fuel supplementing passageway 21, which would have an adverse effect on the action of the operating fluid 10, is prevented.

Figure 2:
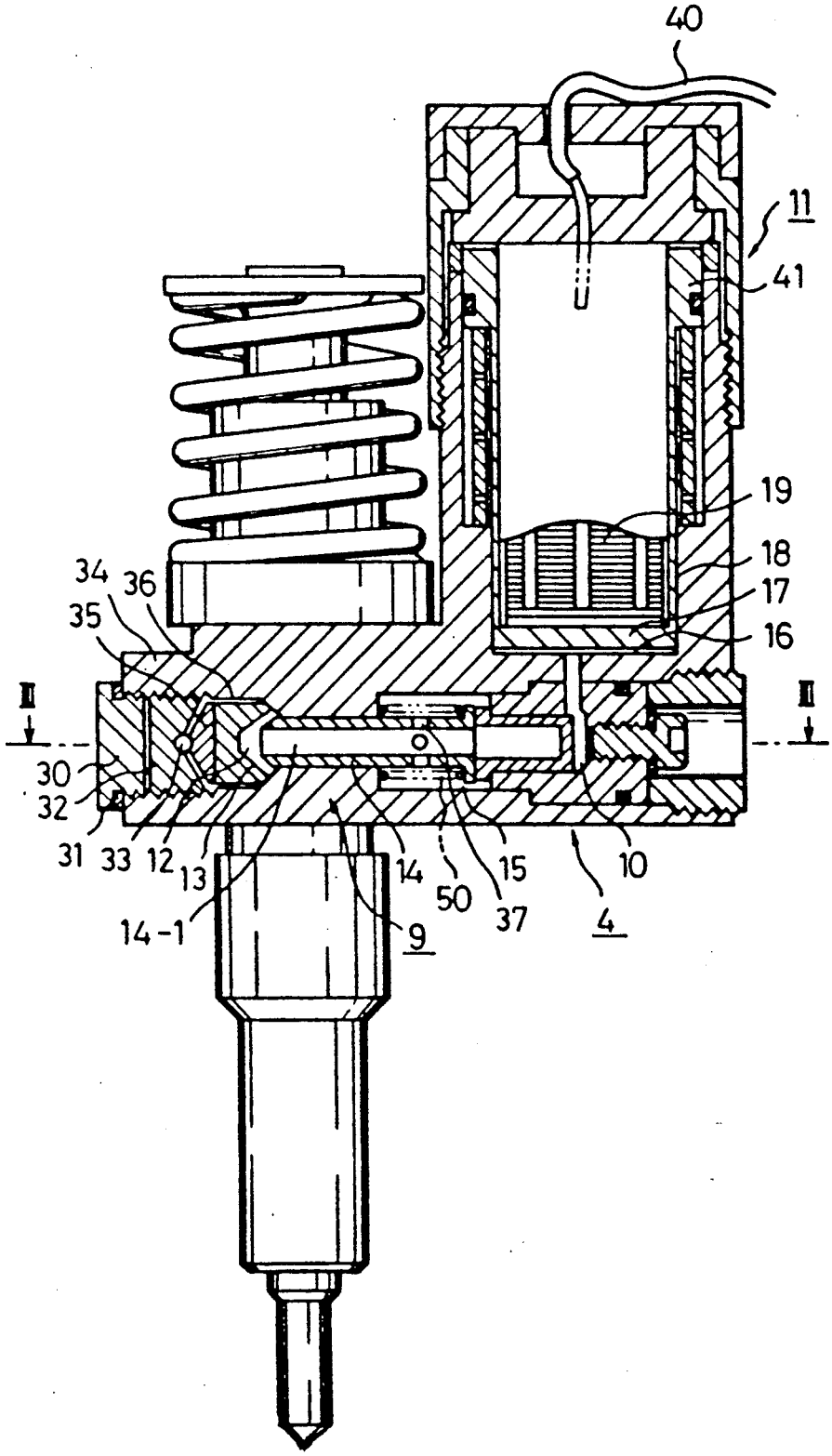
FIG. 2 is a cross-sectional view of a spill valve device acording to the present invention.

Now, a detailed construction of the spill valve device will be described. In FIG. 2, 30 denotes a blind plug, **31*a* gasket, 32 a set screw, 33 a steel ball, 34 a housing, 35 a valve seat holder, and 36 a valve seat member. The housing 34 is provided with an axial bore therethrough having a screw thread at one end thereof to which the blind plug 30 and the set screw 32 are threadingly-engaged, in that order. The set screw 32 urges the valve seat member 36, via a steel ball 33 and a valve seat holder 35, to the right in the figure so that the member 36 is seated in a tapered shoulder in the bore of the housing 34. The end surface of the valve seat menber 36 opposite to the holder 35 forms the value seat 13. The valve member 14 forms a central bore 14-1 for the passage of the fuel, and is provided with side holes 37 which allow a flow of fuel between the central passageway 14-1 and the spill chamber 15**.

The piezoelectric actuator 11 is provided with a piezoelectric unit composed of a stack of thin piezoelectric plates, a casing 41 for holding the piezoelectric unit 19 and by which an electric voltage is applied thereto. The bottom end of the casing 41 forms the piston 17 which, together with the cylinder 18, forms a sealed chamber 16 in which the operating fluid 10 is stored.

An application of an electric voltage having a predetermined polarity (plus voltage) through the wire assembly 40 causes an expansion of the piezoelectric unit 19 in the stacked direction, whereby the piston 17 is moved in a direction such that the operating fluid 10 in the sealed chamber 16 is compressed and urges the valve member 14 toward the valve seat 13 against the force of the spring 50, to seat the valve member 14 on the valve seat 13.

When the polarity of the electric voltage applied to the piezoelectric unit 10 from the wire 40 is reversed, the stack is contracted and the piston 17 moved away from the operating fluid 10, whereby the pressure thereof is reduced, and thus the valve member 14 is moved away from the valve seat 13 by the force of the spring 50. At this stage, a space S1 (FIG. 1) is created between the valve seat 13 and the valve member 14, and as a result, the fuel from the delivery outlet 6 of the pressurizing pump 2 is discharged to the spill chamber 15 via the passageway 8 (FIGS. 1 and 5), the space S1, the central opening 14-1 of the valve member 14, and the openings 37 in the tubular wall of the member 14.

Figure 3:
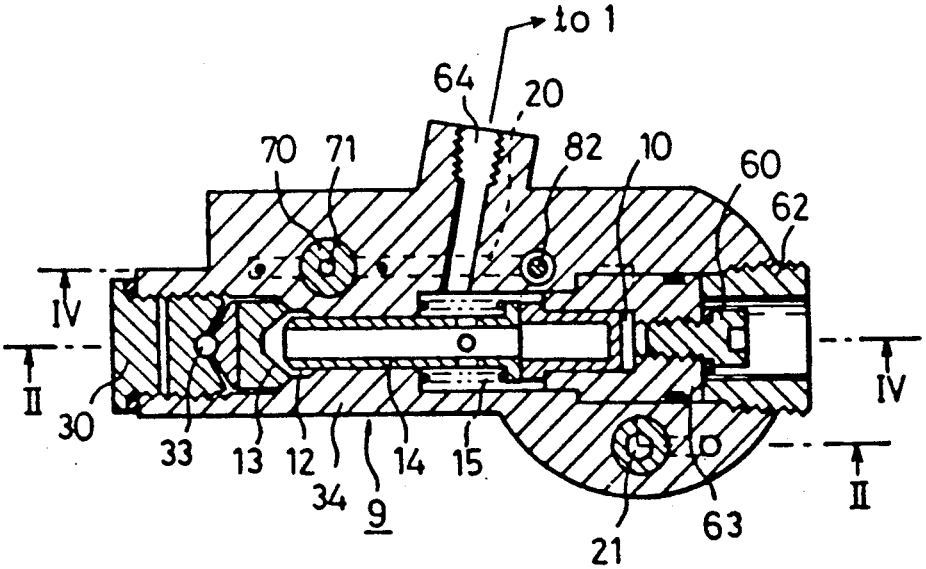
FIG. 3 is a cross-sectional view taken along the line III—III in FIG. 2.

In FIG. 3, 60 denotes a blind plug, 62 a threaded screw, and 63 a tubular member. The housing 34 defines a cylindrical bore to which the tubular member 63 is inserted and is held therein by the threaded screw 62. The blind plug 60 is threadingly engaged with an outer end of the tubular member 63, and thus a chamber for receiving the operating fluid 10 is created. In FIG. 3, the housing 34 has an opening 64 having one end connected to the spill chamber 15 and a second end connected to the fuel tank (not shown in FIG. 3), for returning the spilled fuel to the fuel tank. The fuel supply passageway 21 is also shown in FIG. 3.

Figure 4:
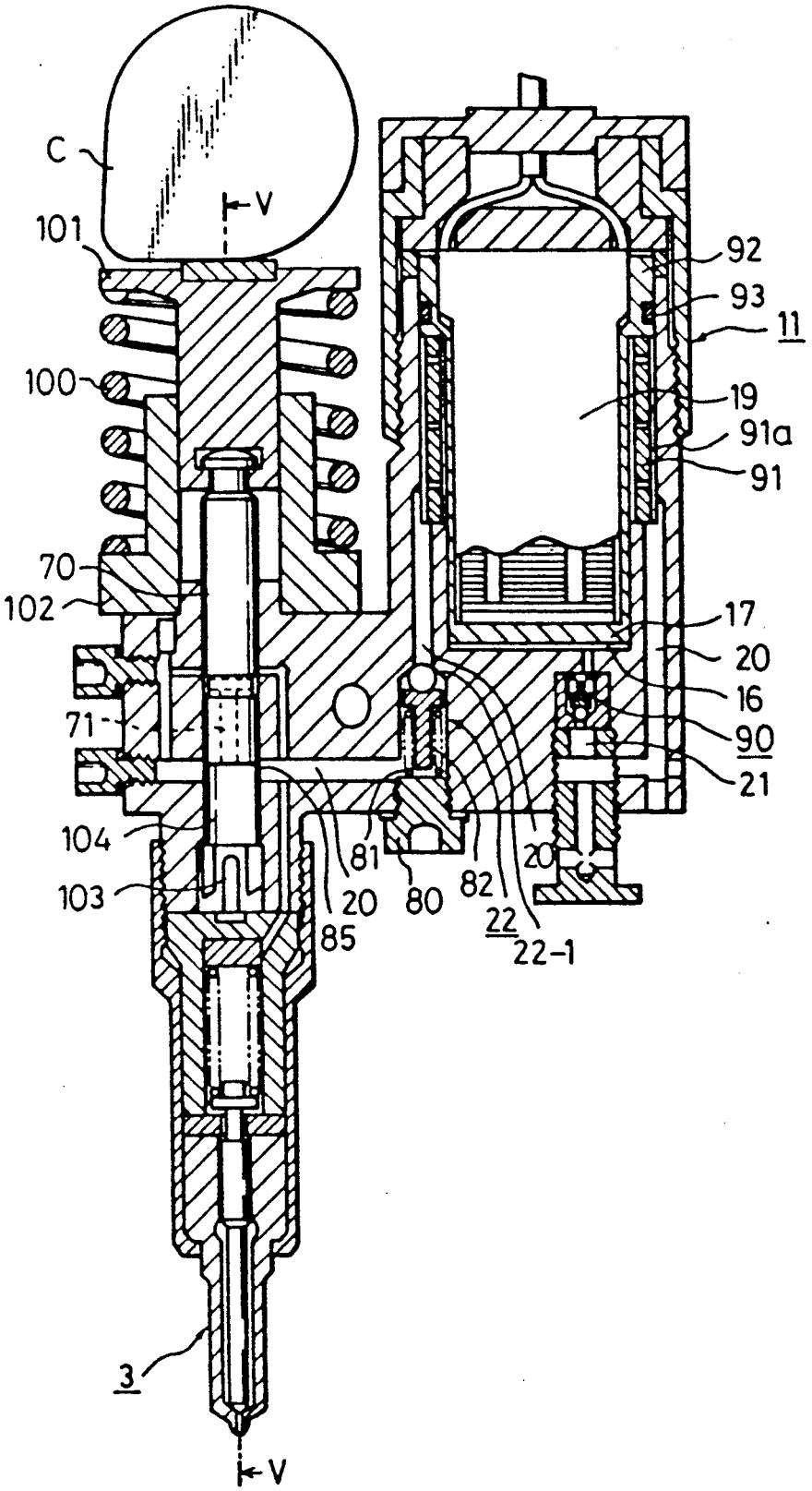
FIG. 4 is a cross-sectional view taken along the line IV—IV in FIG. 3.

In FIG. 4, the pressure pump 2 is provided with a plunger 70 which is axially movable in the cylinder. The bottom end of the plunger 70 forms a fuel discharge passageway 71. The fuel from the fuel tank 1 in FIG. 1 is supplied to the fuel supplementing passageway 21 in FIG. 4 by the feed pump 5, and the fuel supplementing passageway 21 is connected to the communication passageway 20, which is communicated with a check valve assembly 22 via a spring chamber 91*a* formed around the piezoelectric unit 19. The check valve assembly 22 comprises a blind screw 80, a spring 81, a holding member 80, and steel ball 83. The blind screw 80 is inserted to the threaded bore in the housing, so that the spring 81 urges the holder 82 in a direction such that the steel ball 83 is seated on a valve seat 22-1, to close the passageway 20. The portion of the passageway 20 farthest from the piezoelectric unit 19 is connected to the inlet hole 85 of the pressure pump 85, for supplying fuel to the pump 2, and the portion of the communication passageway 20 located between the pressurizing pump 2 and the valve member 22 is connected to the spill chamber 15, not shown in FIG. 4, but understood from the outline view in FIG. 1.

The sealed chamber 16 formed at the bottom of the piston 17 is connected to the fuel supply chamber 21 via a check valve 90, and as a result, the pressurized fuel flows from the chamber 21 via a check valve 90, and as a result, the pressurized fuel from the feed pump 5 is introduced into the passageway 21 and the check valve 90 is opened against the force of the spring 90-1, to charge the fuel to supplement the operating fluid 10 in the sealed chamber 16. The communication passageway 20 is also connected to the annular spring chamber 91*a* formed around the tubular portion of the piston 17. The spring chamber 91*a* is provided with a spring 91 which assists the piston 17 to move upward in FIG. 4 after the downward movement thereof, and thus the fuel in the pressure chamber 104 is pressurized, and the pressurized fuel passes through the bar filter 103 toward the delivery outlet 6 of the pressure pump 6 shown in FIG. 5. Part of the fuel from the outlet 6 is directed into the inlet 7 of the fuel injection nozzle 3 and the remaining fuel is directed toward the valve seat chamber 12 located above the outlet 7, via the passageway 8 as shown in FIGS. 1 and 5.

Figure 5:
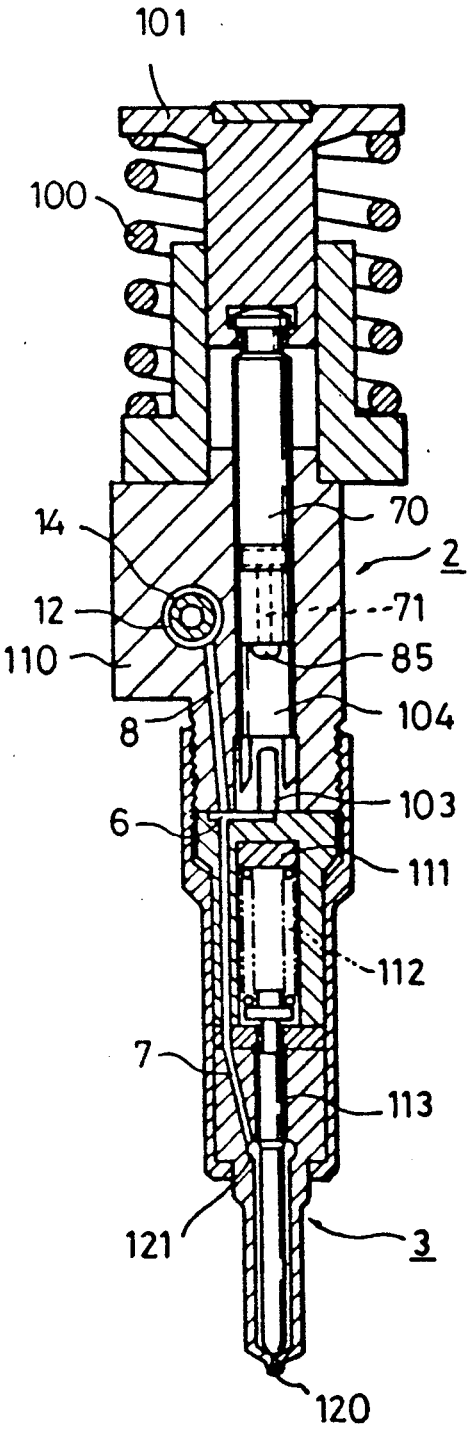
FIG. 5 is a cross-sectional view taken along the line V—V in FIG. 4.

FIG. 5, a pressure pump housing 110 of a pressure pump 2 is formed integrally with the valve housing 34 in FIG. 2. Here, 111 denotes a spacer, 112*a* spring and 113 a needle. The spring 112 urges the needle 113 to a closed position at which an injector nozzle hole 120 is closed. A pressure chamber 121 is provided for generating a fuel pressure force urging the needle 113 to move upward, and when this fuel pressure exceeds a predetermined threshold value, the needle 113 is moved upward against the force of the spring 112, so that the fuel injection nozzle hole 120 is opened to allow a fuel injection.

A fuel discharge passageway 71 having a substantially "T" cross sectional shape is formed in the plunger 70, as shown in FIG. 1, and has a bottom end open to the pressure chamber 104 and an upper end open to an annular recess formed on the cylindrical surface of the plunger 70. When the plunger 70 is at a position, during the downward movement thereof by the tappet 101, at which the pressure chamber 104 is disconnected from the passageway 85, the fuel in the chamber 104 is pressurized for the fuel injection. While the fuel injection is carried out, the spill hole 71 is disconnected from the passageway 20. When a predetermined amount of downward stroke of the plunger 70 is obtained, the spill passageway 71 is connected to the communication passageway 20, which is connected to the spill chamber 15, and as a result, the pressurized fluid in the pressure chamber 104 is discharged into the spill chamber 15 via the pressure pump inlet 85 and a passageway portion which forms the communication chamber 20. The spilled fuel is discharged into the fuel tank 1 via a discharge passageway 123, and as a result, the pressure in the pressurizing chamber 104 is lowered, which causes the inner pressure of the nozzle 3 to be lowered, and thus stops the fuel injection by the nozzle 3.

As is easily seen, the provision of the fuel discharge passageway 71 allows the pressure of the pressure chamber 104 to be forcibly lowered, even if a proper spilling operation of the spill valve device 4 can not be carried out, and as a result, a pressure of fuel introduced into the fuel injection nozzle 3 is maintained at a value not exceeding a predetermined value, even if, for example, the spill valve device 4 is stuck in the closed position.

During the downward stroke of the plunger 70 caused by the rotation of the cam C, the pressure of the chamber 104 is greatly increased, which causes the needle 113 to be moved against the force of the spring 113 to commence the fuel injection from the nozzle 120. When a predetermined stroke of the plunger 70 is reached and a desired amount of fuel is injected into the combustion chamber, the piezoelectric unit 19 is energized by a control circuit described later, to move the piston 17 upward in FIG. 1. As a result, the spill valve 14 is moved against the force of the spring 14 and separated from the valve seat 13, whereby the high pressure fuel in the pressure chamber 104 is allowed to flow to the fuel tank 1 via the passageway 8, the spill chamber 15, and the passageway 123, and thus the fuel injection from the nozzle hole 120 is stopped. The plunger 70 continues to move down, causing the discharge groove 71 to be engaged with the inlet hole 85, whereby the high pressure fuel in the chamber 104 is also allowed to flow to the feed passageway 20. During the downward movement of the plunger 70, the high pressure in the pressure chamber 104 is allowed to flow to the feed passageway 20 via an inevitable clearance formed between the plunger 70 and the cylinder 70-1 when the plunger 70 is at a full stroke position where the groove 70 is open to the part 85, which would adversely affect the operation of the spill valve device 9 in the prior art wherein the passageway 20 is merely connected to the fuel supplementing passageway 21, as already explained in the introductory portion of this specification. Contrary to this, according to the present invention, the check valve 22 provided in the passageway 22 prevents a flow of the high pressure fuel in the chamber 104 during the downward stroke of the plunger 70 to the sealed chamber 16, even if the fuel supplementing passageway 21 is connected to the fuel feed passageway 20.

Figure 6:
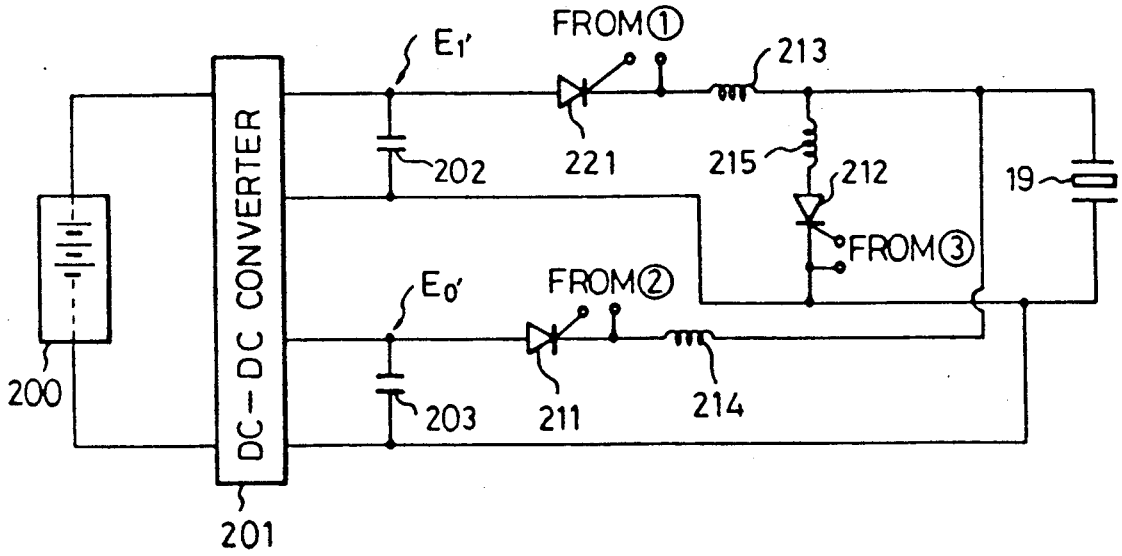
FIG. 6 is a diagrammatic view of a control circuit for an piezoelectric unit as an embodiment of the present invention; and, FIG. 7 is a diagrammatic view of the control circuit for the SCR's shown in FIG. 6.
Figure 7:
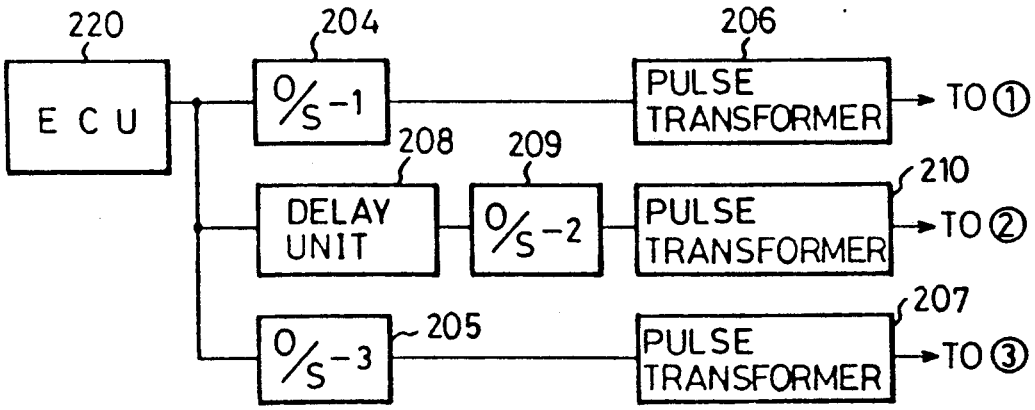

FIGS. 6 and 7 shows a drive circuit for the piezoelectric actuator, wherein 200 denotes a battery for use in a vehicle, and 202 and 203 are electric source capacitors. In FIG. 7, 220 denotes an electronic control unit for controlling the fuel injection apparatus according to the present invention, and is connected to one shot circuits 204 and 205. The one shot circuits 204 and 205 are triggered by signals from the ECU 220 to output pulse signals, having a predetermined period, which are input to pulse transformers 206 and 207, respectively. The trigger signal from the ECU 220 is also supplied to a one shot unit 209 via a delay unit 208 connected to a pulse transformer 210. These pulse transformers 206, 207, and 210 have respective secondary sides which are connected to respective trigger terminals SCR 211, 212 and 221, coils 214 and 215 are connected in series to the respective SCR's.

The operation of expounding the piezoelectric unit 19 in FIG. 1 will be described with reference to FIG. 6. When the SCR is made ON, the electric voltage E1' as charged in the power source capacitor 202 supplies a voltage having a predetermined level to the piezoelectric unit 19, and after a lapse of a predetermined delay time, the SCR 211 is made ON, and the electric voltage E0' as charged in the capacitor 203, which is at a higher level than the electric voltage E1' and which has the same direction as that of the latter, is supplied to the piezoelectric unit 19, and as a result, a two step movement of the piston 17 is obtained to thereby pressurize the operating fluid 100. The two step application of the voltage E1' and E2 to the piezoelectric unit 19 is used for first seating the valve member 14 on the valve seat 13, and then for further urging the valve member 14 against the valve seat by the voltage E0', so that a rebound movement can not occur upon the contact of the valve member 13 with the valve seat 14, and thus the valve is rapidly closed.

To open the valve, the SCR 212 is made ON, the electric voltage in the piezoelectric unit 19 is instantaneously discharged via the coil 215 and the SCR 212, whereby the polarity of the electric voltage as applied to the piezoelectric unit 19 is reversed, and the unit 19 is contracted, to thereby open the valve member 14.

We claim:

1. A fuel injection system for an internal combustion engine, comprising:

a fuel tank for storing fuel;

a feed pump connected to the fuel tank for taking fuel from the fuel tank;

a pressure pump connected to the fuel pump for pressurizing fuel fed from the feed pump, and having a fuel inlet connected to the feed pump and an output for delivery of the fuel;

a feed passageway means for connecting the feed pump to the pressure pump for introducing fuel to be injected;

a fuel injection nozzle connected to the pressure pump for injecting an amount of pressurized fuel into the engine, and having a fuel inlet connected to the outlet of the pressure pump and an outlet nozzle for injecting fuel;

a spill valve device for discharging the fuel when the fuel injection is stopped;

said spill valve device comprising a spill valve body and a piezoelectric actuator for operating the spill valve body to create a pressure for operating the spill valve device when the piezoelectric actuator is operated;

said spill valve body comprising a housing, a valve member slidably arranged in the housing, an operating chamber having a limited volume and connected to the actuator, a valve seat chamber connected between the outlet of the pressure pump to the inlet of the fuel injection nozzle and defining a valve seat on a wall of the housing, and a spill chamber connected to the fuel tank, the valve member being moved toward or away from the valve seat in accordance with the pressure in the operating chamber, said spill chamber being connected to the valve seat chamber for carrying out a spill operation when the valve member (14) is moved away from the valve seat;

the piezoelectric actuator including a cylinder, a piston in the cylinder, a stack of piezoelectric elements for moving the piston, a sealed chamber to which the fuel is charged, the sealed chamber being connected to the operating chamber of the spill valve body, and a fuel supplementing passageway connecting the sealed chamber to the feed pump for supplementing the fuel in the sealed chamber, the fuel supplementing passageway being connected to said feed passageway, and;

means arranged in the feed passageway for preventing flow of the discharged fuel of the pressure pump to the sealed chamber.

2. A system according to claim 1, wherein said preventing means comprises a check valve.

3. A system according to claim 2, wherein said piezoelectric actuator further comprises an annula. chamber formed around the piston the cylinder, said annular passageway forming a part of the communication passageway to cool the piezoelectric actuator by means of the fuel passing through the feed passageway.

4. A system according to claim 1, wherein said pressure pump comprises a cylindrical body, a plunger reciprocally installed in the cylindrical body, a driving member mechanically operated by rotation of the engine, a pressure chamber formed on one side of the plunger in the cylinder, the pressure chamber being normally connected to the communication passageway for introducing fuel from the feed pump, the pressure chamber being disconnected from the feed passageway when the plunger is at a pressurizing stroke thereof so that the fuel in the pressure chamber is forcibly introduced into the nozzle for fuel injection, the pressure pump being further provided with discharge means for discharging the pressure of the pressure chamber when a predetermined maximum pressurizing stroke is reached by the plunger.

* * * * *